US009627165B2

(12) United States Patent
Chen et al.

(10) Patent No.: US 9,627,165 B2
(45) Date of Patent: Apr. 18, 2017

(54) CIRCUIT BREAKER TRIPPING SHAFT WITH OVER-MOLDED LEVERS

(71) Applicant: Siemens Aktiengesellschaft, München (DE)

(72) Inventors: Xinhua Chen, Atlanta, GA (US); Jan Rojko, Conyers, GA (US); Jorg Sizemore, Duluth, GA (US); Ronald Cone, Douglasville, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 7 days.

(21) Appl. No.: 14/854,249

(22) Filed: Sep. 15, 2015

(65) Prior Publication Data

US 2017/0076898 A1 Mar. 16, 2017

(51) Int. Cl.

| | |
|---|---|
| ***H01H 3/04*** | (2006.01) |
| ***H01H 71/10*** | (2006.01) |
| ***H01H 69/00*** | (2006.01) |

(52) U.S. Cl.

CPC ..... *H01H 71/10* (2013.01); *H01H 69/00* (2013.01); *H01H 2235/00* (2013.01)

(58) Field of Classification Search

CPC .. H01H 71/10; H01H 71/1009; H01H 71/505; H01H 2001/223

USPC ..... 200/335, 329; 335/10, 172

See application file for complete search history.

(56) References Cited

U.S. PATENT DOCUMENTS

| | | | | |
|---|---|---|---|---|
| 5,705,968 | A * | 1/1998 | Beck | H01H 71/74 335/167 |
| 6,727,788 | B1 * | 4/2004 | Lawson | H01H 71/505 335/167 |
| 8,749,326 | B2 | 6/2014 | Yang | |
| 2009/0189719 | A1 | 7/2009 | Yang | |
| 2012/0085627 | A1 | 4/2012 | Yang | |
| 2013/0313089 | A1 | 11/2013 | Chen | |
| 2014/0251769 | A1 | 9/2014 | Chen | |

FOREIGN PATENT DOCUMENTS

| | | | |
|---|---|---|---|
| WO | 2012051098 | A1 | 4/2012 |

* cited by examiner

*Primary Examiner* — Vanessa Girardi

(57) ABSTRACT

A tripping shaft apparatus for a circuit breaker. Tripping shaft apparatus includes a rigid shaft portion and a polymer shaft portion molded onto the rigid shaft portion, wherein the polymer shaft portion includes a first molded lever. At least one other lever is a part of the tripping shaft apparatus. A torsion spring is received over the shaft between the first molded lever and the second lever providing an integral torsion spring positioned between the levers. Circuit breaker tripping assemblies and methods of assembling a circuit breaker tripping assembly are provided, as are other aspects.

18 Claims, 7 Drawing Sheets

CIRCUIT BREAKER TRIPPING SHAFT WITH OVER-MOLDED LEVERS

FIELD

The present invention relates generally to circuit breakers for interrupting current from an electrical power supply, and more particularly to tripping shaft assemblies for circuit breakers.

BACKGROUND

Electronic circuit breakers are used in certain electrical systems for protecting branch electrical circuits that are coupled to an electrical power supply. Some such circuit breakers, such as for low voltage tripping applications (e.g., 100V to 600V), may include a tripping shaft that is mounted in a rigid frame. The tripping shaft includes multiple lever arms that are configured to interface with various tripping components of the circuit breaker, such as a maglatch actuator, interlock, or the like. Assembly of such tripping shafts has been quite complicated and time consuming. Such tripping shafts are typically spring biased so that upon actuation thereof, they may return to a common rotational orientation under a restoring force provided by a return spring. Assembly of the return spring to the tripping shaft can be quite difficult. Accordingly, there is a need for a tripping shaft and tripping assemblies that are easier to assemble and provide adequate spring bias to the tripping shaft.

SUMMARY

In a first aspect, a tripping shaft apparatus is provided. The tripping shaft apparatus includes a rigid shaft portion, a first over-molded shaft portion molded onto the rigid shaft portion, the first over-molded shaft portion including at least a first molded lever, a second lever spaced from the first lever, and a torsion spring located between the first molded lever and the second lever.

According to another aspect, a circuit breaker tripping assembly is provided. The circuit breaker tripping assembly includes a frame including first side frame and second side frame, each including a journal, a tripping shaft apparatus including a shaft including a rigid shaft portion including bearing portions configured to mount to the journals of the first side frame and the second side frame, at least a first over-molded shaft portion molded onto the rigid shaft portion, the first over-molded shaft portion including a first molded lever, and a second lever spaced from the first lever, and a torsion spring mounted to the shaft between the first molded lever and the second lever.

According to another aspect, a method of assembly of a circuit breaker tripping assembly is provided. The method includes providing a tripping shaft apparatus including a rigid shaft portion and bearing portions, wherein the bearing portions include larger dimension areas and smaller dimension areas, a first over-molded shaft portion molded onto the rigid shaft portion, the first over-molded shaft portion including at least a first molded lever, a second lever spaced from the first molded lever, and a torsion spring located between the first molded lever and the second lever, providing a frame including first and second side frames including first and second journals with entry slots into the first and second journals, and inserting the smaller dimension areas of the bearing portions of the tripping shaft apparatus through entry slots in the first and second side frames.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its details may be modified in various respects, all without departing from the scope of the present invention. The invention is to cover all modifications, equivalents, and alternatives falling within the scope of the appended claims.

BRIEF DESCRIPTION OF DRAWINGS

The drawings, described below, are for illustrative purposes only and are not necessarily drawn to scale. The drawings are not intended to limit the scope of the invention in any way. Wherever possible, the same or like reference numbers will be used throughout the drawings to refer to the same or like parts.

DESCRIPTION

Figure 1A:
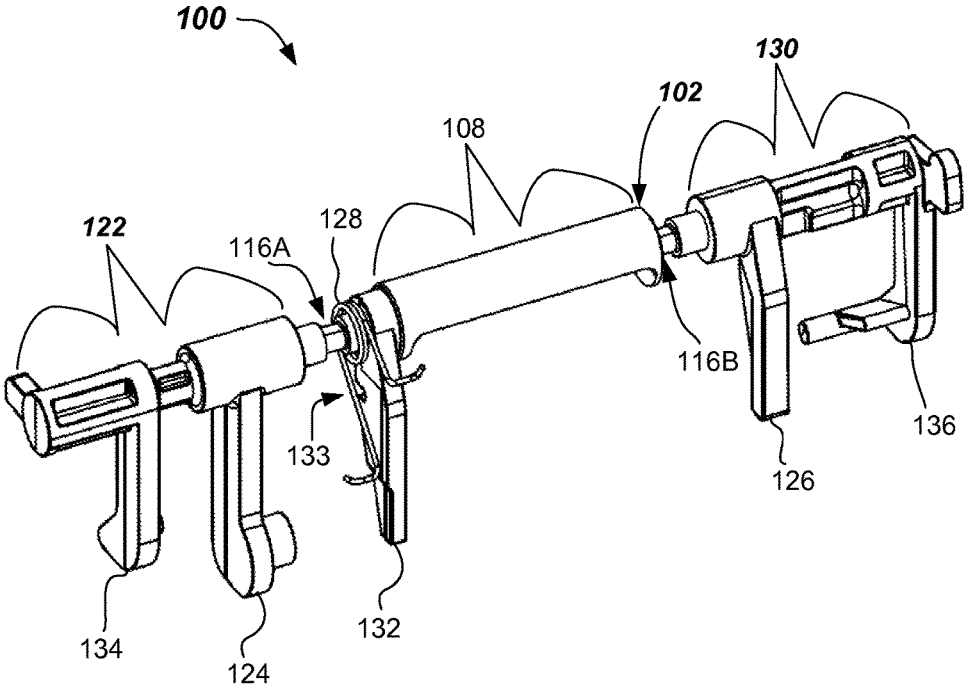
FIG. 1A illustrates an isometric view of a tripping shaft apparatus of a circuit breaker according to one or more embodiments.

Because such tripping shafts have relatively large levers positioned along their length, and because installing a spring over the lever is difficult and/or complicated, the location of the spring may be generally relegated to be at the end of the shaft or of complicated design because the spring cannot be received over the levers. Furthermore, because some new versions of the tripping shaft may include levers that are positioned outside of each side frame the tripping assembly, providing spring biasing to the tripping shaft may be further complicated.

In view of the foregoing difficulties, and, in particular, the difficulty in assembly of tripping shafts to circuit breaker frames, and difficulties in providing spring biasing thereof, a novel tripping shaft apparatus for a circuit breaker tripping assembly is provided. The novel tripping shaft apparatus includes an integrated torsion spring. The torsion spring may be provided inboard of one or more levers of the tripping shaft apparatus. Inboard as used herein means that the spring is provided on the shaft between at least two levers of the tripping shaft.

The tripping shaft apparatus according to one or more embodiments includes an over-molded shaft including an integral torsion spring that is provided inboard of at least two levers, i.e., between the two levers. In particular, the tripping shaft includes a rigid shaft portion (e.g., a rigid central portion) that is over-molded with a moldable material (e.g., a polymer) at one or both ends, and the torsion spring is installed on a rigid shaft portion prior to molding. The various levers and possibly other shaft portions may be molded on either side of the torsion spring. Thus, the over-molded tripping shaft apparatus includes an integrated torsion spring provided inboard of the levers. The tripping shaft apparatus 1) enables the torsion spring to be more centrally positioned, and 2) allows the torsion spring to be located so that it is able to engage directly with the a side frame of the circuit breaker frame, and 2) provides for ease of assembly.

The improved tripping shaft apparatus comprises a rigid shaft portion and a first polymer shaft portion over-molded onto the rigid shaft portion, wherein the first polymer shaft portion may include one or more than one molded levers. A second lever may be provided that is spaced from the first molded lever. A second polymer shaft portion may also include one or more than one molded levers. The second lever may be molded as a part of the second polymer shaft portion in some embodiments. Tripping shaft apparatus includes the integral torsion spring received over the shaft between at least two levers, such as between first molded lever and the second lever.

The torsion spring may reside in a sealed mold pocket during the process of over-molding the rigid shaft portion with polymer (e.g., a fiberglass-filled plastic) as will be apparent from the following. Upon completion of the over-molding process, the torsion spring is integrated on the shaft and located on the tripping shaft between levers.

In another aspect, a circuit breaker tripping assembly is provided. Circuit breaker tripping assembly includes a frame including first side frame and second side frame, each including a journal, and a tripping shaft apparatus mounted to the frame at the journals. The tripping shaft apparatus includes a rigid shaft portion including bearing portions configured to mount to the journals of the first side frame and the second side frame, at least a first over-molded portion that is molded onto the rigid shaft portion, the first over-molded portion including at least one molded lever. Another lever may be provided on the tripping shaft apparatus, and may also be molded, and the torsion spring is mounted to the tripping shaft between the levers.

In another broad aspect, a method of assembling a tripping shaft apparatus to a frame of a circuit breaker is provided. The method involves, in one aspect, providing a tripping shaft with a torsion spring included between levers of the tripping shaft, and installing the tripping shaft to the circuit breaker side frames. This may be accomplished without mechanical crimping, secondary mechanism to retain the shaft in the side frames, or any special tooling.

Advantageously, the present invention solves several problems of the prior art, i.e., difficulty of assembly of the tripping shaft to the journals of the side frames of a circuit breaker, and difficulty of including spring biasing to the tripping shaft, especially when the tripping shaft includes levers that are located outboard of the journal locations of the side frames.

These and other embodiments of tripping shaft apparatus, circuit breaker tripping assemblies and methods of assembling a tripping shaft to a frame of a circuit breaker of the present invention are described below with reference to FIGS. 1A-5.

Referring now in specific detail to FIG. 1A, a tripping shaft apparatus 100 of a circuit breaker is shown. The circuit breaker may be a thermal magnetic circuit breaker, for example. The thermal magnetic circuit breaker may have a rating of between about 100 Amps to about 2,000 Amp, for example. The tripping shaft apparatus 100, as will be apparent from the following, features construction that allow the tripping shaft apparatus 100 to be installed quickly and effectively, and wherein spring biasing of the tripping shaft is provided at a desired location of the tripping shaft apparatus 100.

Figure 1B:
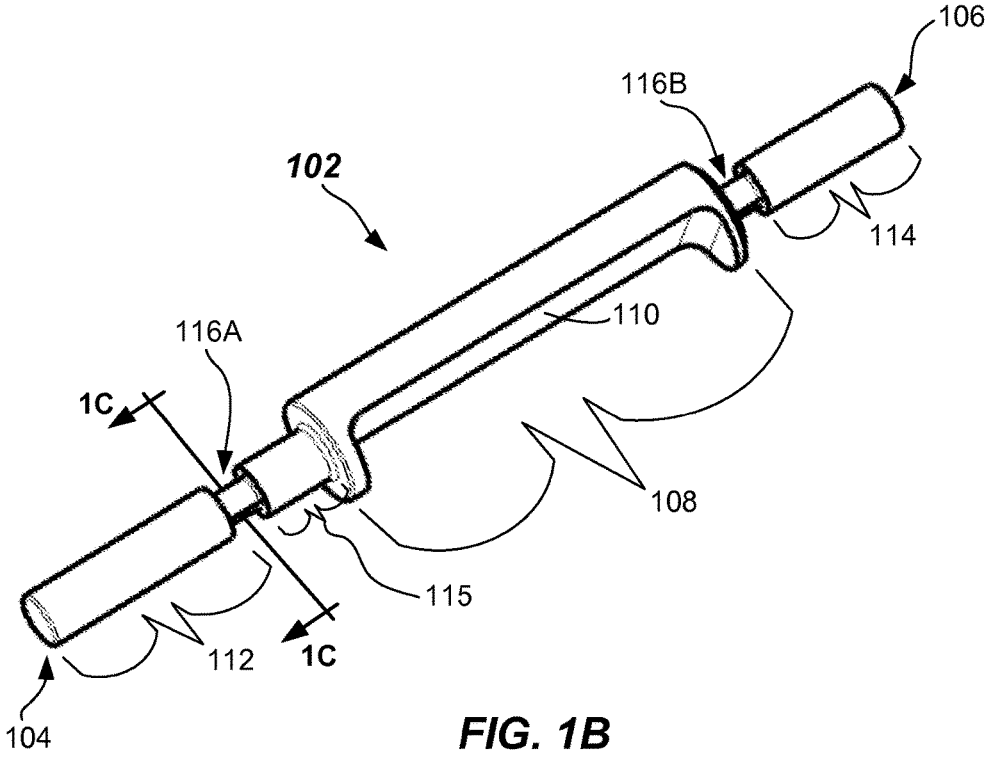
FIG. 1B illustrates an isometric view of a rigid shaft portion of a tripping shaft apparatus of a circuit breaker according to one or more embodiments.

The tripping shaft apparatus 100 includes a rigid shaft portion 102 having a first end 104 and a second end 106 (see FIG. 1B). Rigid shaft portion 102 may include a central portion 108 including a contact surface 110 configured to engage with a latch of the tripping mechanism (not shown) of the circuit breaker. The contact surface 110 may be a planar surface in some embodiments. Rigid shaft portion 102 may further include first interface portion 112 and may also include a second interface portion 114 on the other side of the central portion 108, The first interface portion 112 and the second interface portion 114 may be over-molded and interface with molded material (e.g., a polymer) as described below. In some embodiments, the rigid shaft portion 102 may include third interface portion 115, which may be partially over-molded and interface with molded material (e.g., a polymer). First interface portion 112, second interface portion 114, and third interface portions 115 may be cylindrical and may each include a knurled outer surface to enhance bonding therewith.

The rigid shaft portion 102 may include first bearing portion 116A and second bearing portion 116B spaced apart from the first bearing portion 116A. The first and second bearing portions 116A, 116B may be configured to register with a frame 350 (FIG. 3) of the circuit breaker tripping assembly 301 (to be described later herein). Rigid shaft portion 102 may be a rigid material, such as a metal (e.g., steel) or the like. However, depending upon the size of the circuit breaker and the forces involved, other suitably rigid materials may be used.

Figure 1C:
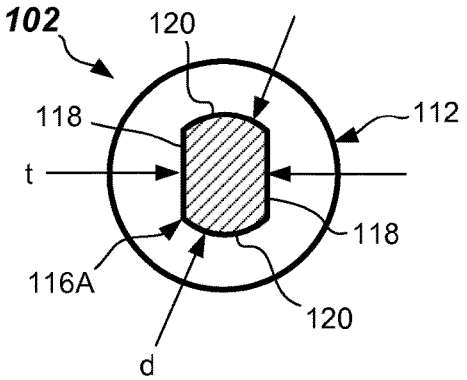
FIG. 1C illustrates a cross-sectioned end view of a rigid shaft portion taken along section line 1C-1C according to one or more embodiments.
Figure 4A:
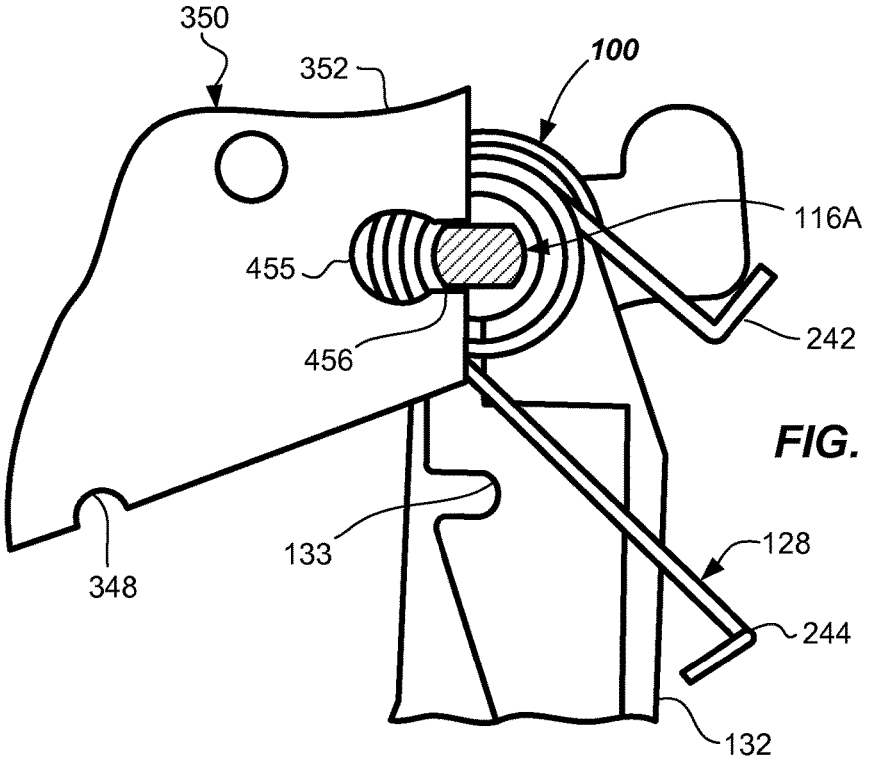
FIGS. 4A and 4B illustrates partial cross-sectioned side views of a tripping shaft apparatus in various stages of being assembled to a frame of a circuit breaker tripping assembly according to one or more embodiments.
Figure 4B:
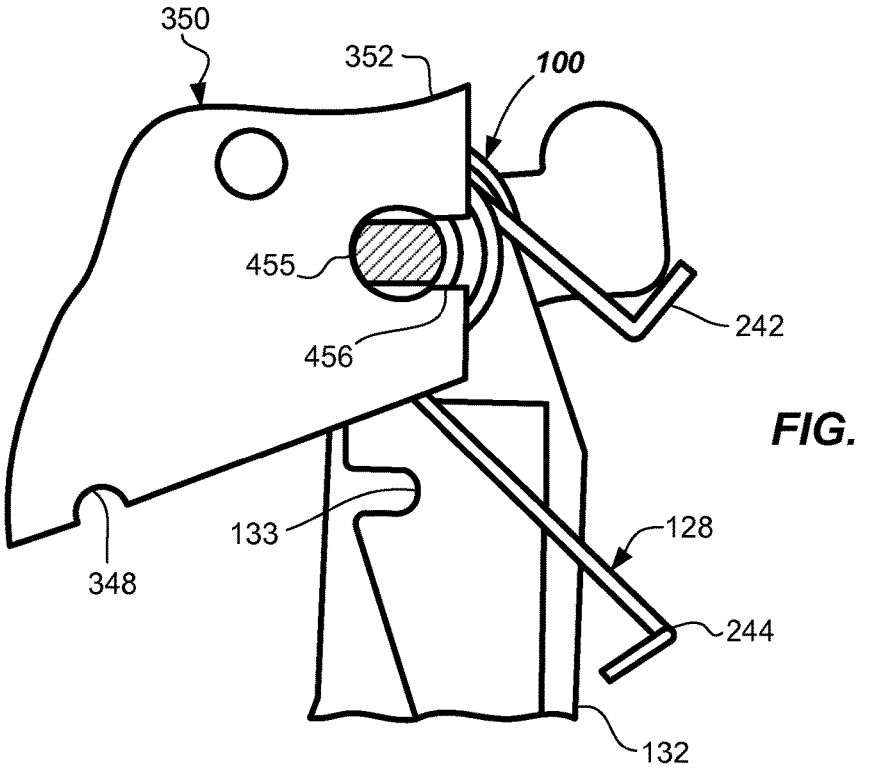

Bearing portions 116A, 116B may each include a cross-sectional shape as is shown in FIG. 1C, wherein flats 118 may be formed on both sides to form a smaller dimension area for assembly clearance with an entry slot 456 formed in the frame 350, as will be apparent from the discussion relative to FIGS. 4A and 4B herein. Bearing portions 116A, 116B may include a diameter d of between about 4 mm and 5 mm, for example. The smaller dimension may comprise a thickness t measured across the flats 118 that may be between about 3.2 mm and 3.6 mm, for example. The flats 118 may be of approximately equal size. Bearing portions 120 located between the flats 118 provide bearing surfaces for the tripping shaft apparatus 100 to rotate within journals 455 of side frames 352, 354, as will be further explained herein.

Again referring to FIG. 1A, the tripping shaft apparatus 100 further includes a first over-molded shaft portion 122 molded onto the first interface portion 112 of the rigid shaft portion 102 at the first end 104, for example. The first over-molded shaft portion 122 may include a first molded lever 124, which may be a molded. The term "molded," as used herein means that the shape of the component is provided by solidifying a molding material (e.g., a polymer, such as a moldable thermoset or thermoplastic material) in a multi-part mold having a mold cavity.

The tripping shaft apparatus 100 includes a second lever 126 that is spaced from the first molded lever 124 along a length thereof, and a torsion spring 128 located between the first molded lever 124 and the second lever 126.

In some embodiments, the second lever 126 may also be molded, and may be part of a second over-molded shaft portion 130. In other embodiments, the second lever may be cast or machined metal. In the case where a second over-molded shaft portion 130 is used, the second over-molded shaft portion 130 may be molded on the second interface portion 114 on the second end 106 of the rigid shaft portion 102 opposite the first end 104. Both the first over-molded shaft portion 122 and the second over-molded shaft portion 130 may be formed of a moldable material, such as a polymer. More specifically, a polybutylene terephthalate (PBT) polymer may be used. The polymer may be filled with fiberglass fibers at about 25%-30% loading by volume, for example. Other suitable polymers may be used. First over-molded shaft portion 122 and second over-molded shaft portion 130 may be formed in a common mold and during a common molding operation. Optionally, more than one molding operation may be used to mold the first over-molded shaft portion 122 and second over-molded shaft portion 130. In some embodiments, one or more additional levers may be molded. For example, a third lever 132 may be over-molded on the first end 104 or the second end 106.

Figure 1D:
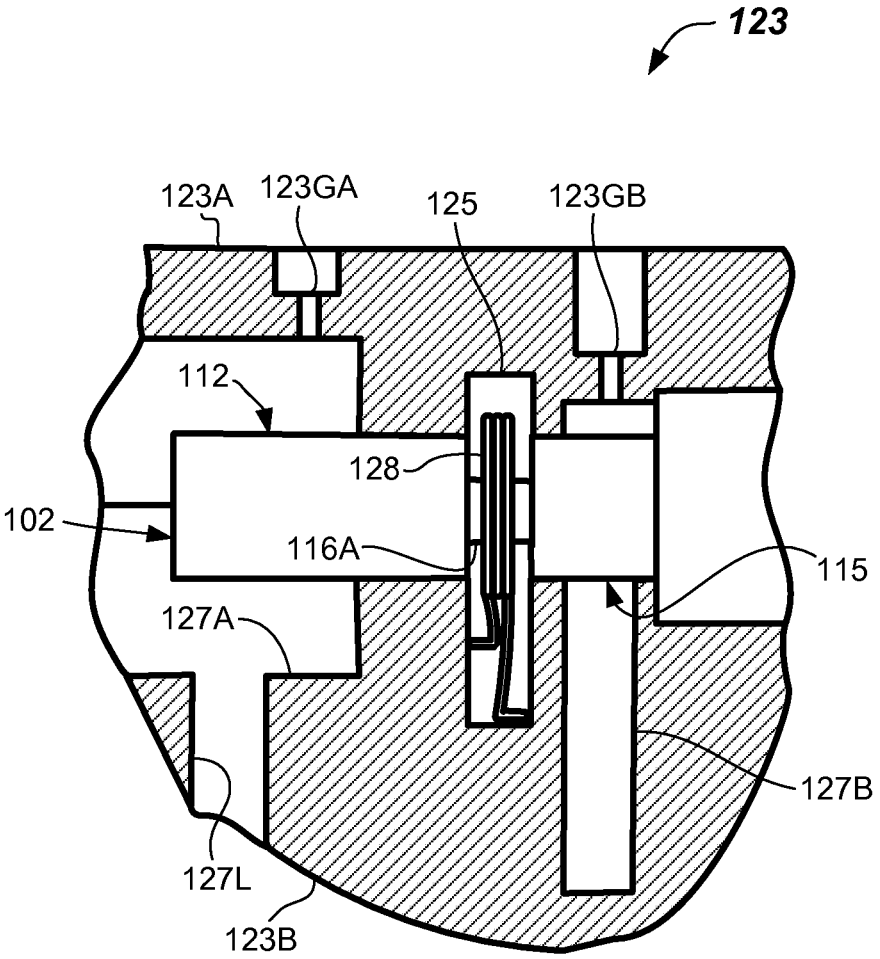
FIG. 1D illustrates a partial cross-sectioned side view of a mold including a cavity for providing an integral torsion spring according to one or more embodiments.

For example, as shown in FIG. 1D, a portion of a mold 123 is shown. Mold 123 may be an injection mold and may include at least first and second mold parts 123A, 123B, which can be separated from one another. The rigid shaft portion 102 is inserted in the mold 123 along with the torsion spring 128. The torsion spring 128 is received in spring receiving cavity 125, and may be positioned at the first bearing portion 116A. The mold 123 is closed, and molding material may be injected under heat and pressure through gate 123GA into first mold cavity 127A to form the first over-molded shaft portion 122 (FIG. 1A) that is molded onto the first interface portion 112. The first molded lever 124 is also formed during the molding process in a cavity portion 127L of the first mold cavity 127A. Molding material may also be injected into a second mold cavity 127B through gate 123GB to form the third lever 132 on the third interface portion 115. During the molding process, parts of the mold 123 seal against the rigid shaft portion 102 on either side of the spring receiving cavity 125 to prevent molding material from entering into the spring receiving cavity 125.

As depicted, a third lever 132 may be molded onto the third interface portion 115 on the first end 104 on an inboard side of the first bearing portion 116A whereas the first molded lever 124 may be molded on an outboard side of the first bearing portion 116A. Additional levers may be molded as part of the first over-molded shaft portion 122 and/or the second over-molded shaft portion 130, or elsewhere. For example, fourth lever 134 and fifth lever 136 may be used to interface with a booster or secondary latch, for example.

Figure 2:
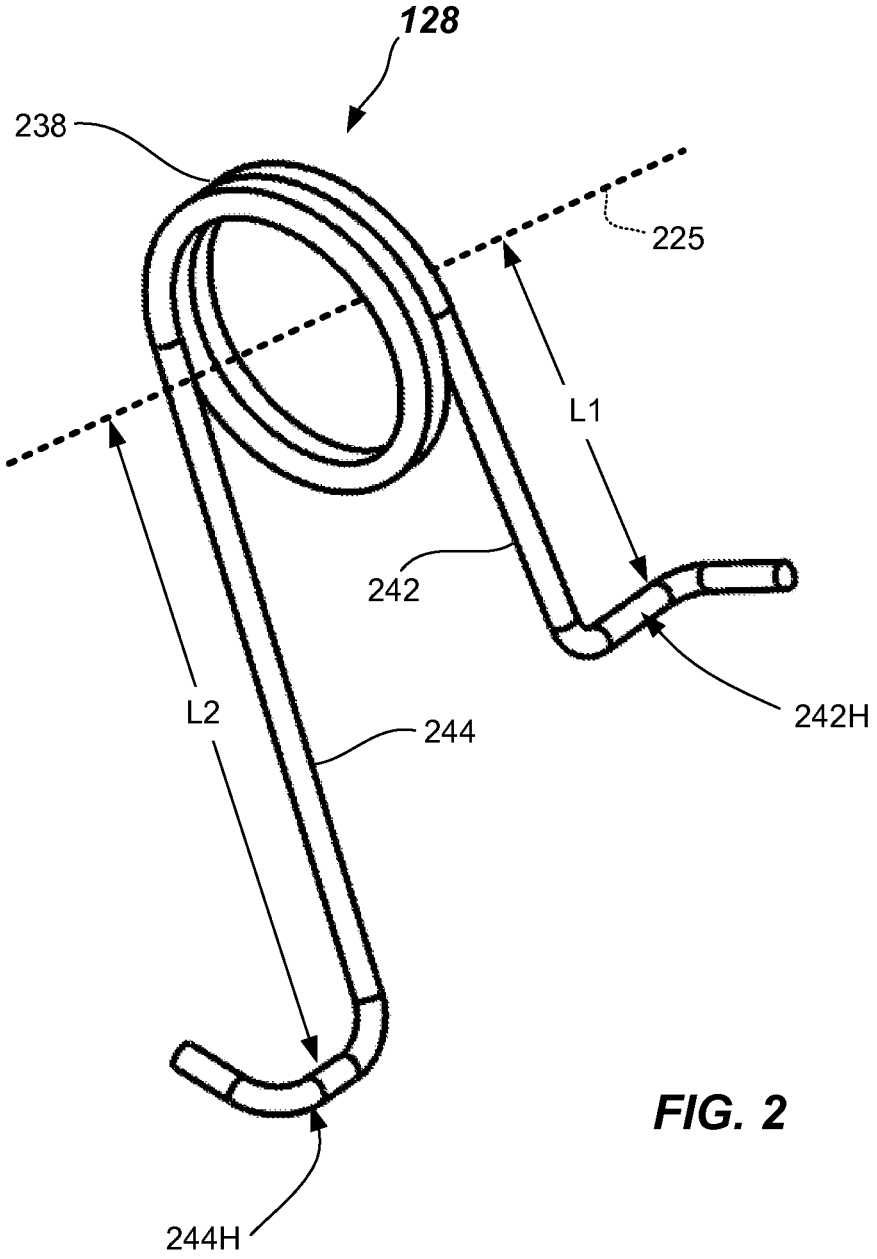
FIG. 2 illustrates an isometric view of a torsion spring of a tripping shaft apparatus according to one or more embodiments.

In more detail, the torsion spring 128, as best shown in FIG. 2, includes a wound central portion 238 that may be configured as a closed circle to be received over a registry portion (e.g., an outer diameter) that may be part of the third interface portion 115 of the rigid shaft portion 102. The inner diameter of the wound central portion 238 of the torsion spring 128 that interfaces with the registry portion may be about 8 mm, for example. An outer diameter of the registry portion of the third interface portion 115 may be about 6 mm, for example. Wound central portion 238 of the torsion spring 128 may include 2 or more winds (e.g., approximately 2½ winds) of a 0.8 mm to 1 mm diameter steel spring wire. Other materials, sizes, and number of winds may be used. As depicted in FIG. 1A, the torsion spring 128 may be preferably positioned inboard of the first bearing portion 116A, or optionally inboard of the second bearing portion 116B, such that the torsion spring 128 may interface with first side frame 352 or second side frame 354.

Torsion spring 128 may include a first spring arm 242 that is configured to register on a lever. For example, first spring arm 242, which may be relatively shorter, may be configured to register on the third lever 132 located between the first molded lever 124 and second lever 126, which may also be molded in some embodiments. The first spring arm 242 may include a length L1, measured from a physical center (e.g., central axis 225) of the wound central portion 238 of the torsion spring 128 to a location of registry with a lever (e.g., third lever 132) of about 11 mm, for example. First spring arm 242 may register in a recess 133 formed in the third lever 132, for example.

Torsion spring 128 may also include a second spring arm 244, that may be relatively longer than the first spring arm 242, and that may be configured to register on the frame 350, such as the first side frame 352 (FIG. 3), or optionally the second side frame 354. The second spring arm 244 may include a length L2, measured from the physical center (e.g., central axis 225) of the wound central portion 238 of the torsion spring 128 to a registry with the lever (e.g., third lever 132) of about 21 mm, for example. The third lever 132 may be molded to the third interface portion 115 and the first spring arm 242 may have a bent end 242H that may be in the form of a hook that may be configured to register in the recess 133 formed in the third lever 132. The second spring arm 244 may also be configured to have a bent end 244H that may be in the form of a hook and that may register in a pocket 348 (FIGS. 4A-4B) formed in the first side frame 352 (or optionally, the second side frame 354).

Figure 3:
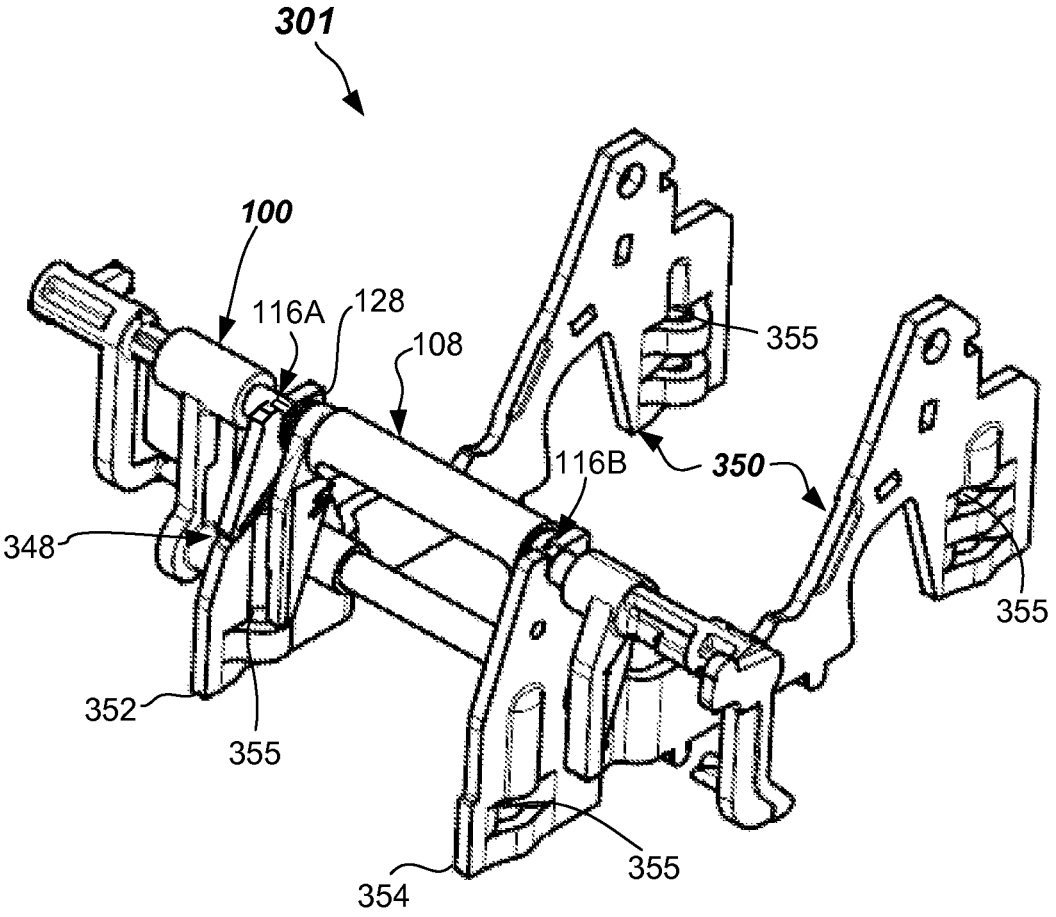
FIG. 3 illustrates an isometric view of a circuit breaker tripping assembly including a tripping shaft apparatus installed in a frame according to one or more embodiments.

As shown in FIG. 3, the tripping shaft apparatus 100 is configured to mount to a frame 350 of the tripping assembly 301. Frame 350 may be formed from several frame portions in some embodiments. According to some embodiments, the frame 350 may include a left side frame 352 and a right side frame 354, which may be made of stamped steel, for example. In the depicted embodiment, first and second side frames 352, 354 may be mounted to a larger housing assembly (e.g., a thermosetting plastic housing—not shown) of a circuit breaker (e.g., electronic trip and thermal-magnetic trip circuit breaker) by inserting suitable fasteners in mounting features 355. The fasteners may include screws, bolts, rivets, or the like.

As further illustrated in FIG. 3, the tripping shaft apparatus 100 includes the central portion 108 extending between the first side frame 352 and second side frame 354. The tripping shaft apparatus 100 may be mounted for rotation in the frame 350 at both of the first and second ends 104, 106 (FIG. 1B). In the depicted embodiment, the bearings portions 116A, 116B of the tripping shaft apparatus 100 are mounted in journals 455, as best shown in FIG. 4B. The journals 455 of the first and second side frames 352, 354 may be formed identically.

FIGS. 4A and 4B illustrate the assembly of the tripping shaft apparatus 100 to the frame 350. Each of the first and second side frames 352, 354 include journals 455 that may be configured to receive the bearing portions 116A, 116B. In particular, as shown assembled in FIG. 4B, the bearing portions 116A, 116B of the rigid shaft portion 102 may be configured to rest in first and second journals 455 of the first side frame 352 and the second side frame 354 (not shown in FIG. 4B). The bearing portions 116A, 116B, as shown in FIG. 1C, may comprise larger dimension areas (e.g., bearing regions 120) adapted to contact the journals 455 and smaller dimension areas (e.g., across the flats 118) that may be configured to pass through an entry slot 456 of the first side frame 352 and the second side frame 354. Once rotated into an operating configuration by rotating the tripping shaft apparatus 100 counterclockwise from the configuration shown in FIG. 4B, the torsion spring 128 may become pre-stressed such that the bent ends 242H, 244H of the first spring arm 242 and the second spring arm 244 come to rest in the recess 133 and pocket 348, respectively, and a spring bias torque of about 65 N-mm may be provided to the tripping shaft apparatus 100 relative to the frame 350. Thus, the combination of the flats 118 on the bearing portions 116A, 116B and the integration of the torsion spring 128 during molding allows for both ease of assembly and providing spring biasing to the tripping shaft apparatus 100.

Figure 5:
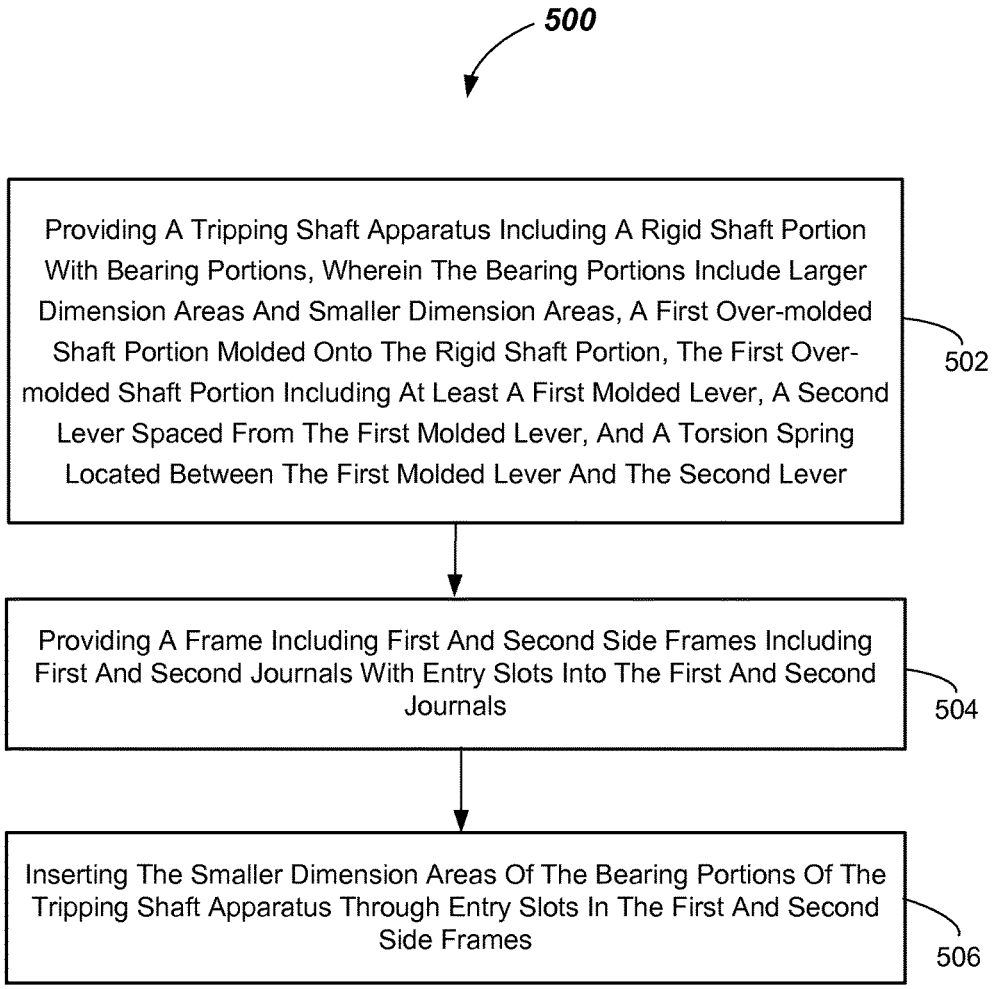
FIG. 5 is a flowchart illustrating a method of assembly of a circuit breaker tripping assembly according to embodiments.

FIG. 5 is a flowchart illustrating a method of assembly of a circuit breaker tripping assembly (e.g., tripping assembly 301) according to one or more embodiments of the present invention. The method 500 includes, in 502, providing a tripping shaft apparatus (e.g., tripping shaft apparatus 100) including a rigid shaft portion (e.g., rigid shaft portion 102) with bearing portions (e.g., bearing portions 116A, 116B), wherein the bearing portions include larger dimension areas (e.g., larger dimension areas across bearing regions 120) and smaller dimension areas (e.g., smaller dimension areas across the flats 118), a first over-molded shaft portion (e.g., first over-molded shaft portion 122) molded onto the rigid shaft portion, the first over-molded shaft portion including at least a first molded lever (e.g., first molded lever 124), a second lever (e.g., second lever 126) spaced from the first molded lever, and a torsion spring (e.g., torsion spring 128) located between the first molded lever and the second lever.

Further, the method 500 includes, in 504, providing a frame (e.g., frame 350) including first and second side frames (e.g., first side frame 352 and second side frame 354) including first and second journals (e.g., journals 455) with entry slots (e.g., entry slots 456) into the first and second journals.

To assemble, the method 500 includes, in 506, inserting the smaller dimension areas (e.g., smaller dimension areas across flats 118) of the bearing portions of the tripping shaft apparatus through entry slots (e.g., entry slots 456) in the first and second side frames (e.g., first side frame 352 and second side frame 354).

The method 500 may further include rotating the tripping shaft apparatus (e.g., tripping shaft apparatus 100) to register the spring arms (e.g., first spring arm 242 and second spring arm 244) of the torsion spring (e.g., torsion spring 128) on the first molded lever (e.g., first molded lever 124) and one of the first and second side frames (e.g., first side frame 352 and second side frame 354) to pre-stress the torsion spring 128.

While the invention is susceptible to various modifications and alternative forms, specific embodiments and methods thereof have been shown by way of example in the drawings and are described in detail herein. It should be understood, however, that it is not intended to limit the invention to the particular apparatus, assemblies, or methods disclosed, but, to the contrary, the intention is to cover all modifications, equivalents, and alternatives falling within the scope of the appended claims.

What is claimed is:

1. A circuit breaker tripping assembly, comprising:
a frame including a first side frame and a second side frame, each including a journal;
a tripping shaft apparatus including:
a shaft including
a rigid shaft portion including bearing portions configured to mount to the journals of the first side frame and the second side frame,
at least a first over-molded shaft portion molded onto the rigid shaft portion, the first over-molded shaft portion including a first molded lever, and
a second lever spaced from the first molded lever; and
a torsion spring mounted to the shaft between the first molded lever and the second lever, wherein the torsion spring comprises a first spring arm that is configured to register on a third lever located between the first molded lever and second lever.

2. A circuit breaker tripping assembly, comprising:
a frame including a first side frame and a second side frame, each including a journal;
a tripping shaft apparatus including:
a shaft including
a rigid shaft portion including bearing portions configured to mount to the journals of the first side frame and the second side frame,
at least a first over-molded shaft portion molded onto the rigid shaft portion, the first over-molded shaft portion including a first molded lever, and
a second lever spaced from the first molded lever; and
a torsion spring mounted to the shaft between the first molded lever and the second lever, wherein the torsion spring includes a wound central portion received over a registry portion of the rigid shaft portion, a first spring arm configured to register on a lever, and a second spring arm configured to register on one of the first and second side frames.

3. The circuit breaker tripping assembly of claim 2, wherein the rigid shaft portion comprises a first interface portion configured to interface with the first over-molded shaft portion, and a second interface portion configured to interface with a second over-molded shaft portion.

4. The circuit breaker tripping assembly of claim 2, wherein the first spring arm is configured to register in a recess formed in a third lever, and the second spring arm is configured to register in a pocket formed in one of the first and second side frames.

5. The circuit breaker tripping assembly of claim 2, wherein the rigid shaft portion comprises bearing portions configured to rest in a first journal of a first side frame, and in a second journal of a second side frame.

6. The circuit breaker tripping assembly of claim 5, wherein the bearing portions comprise larger dimension areas adapted to contact the first and second journals, and smaller dimension areas configured to pass through an entry slot of the first and second side frames.

7. The circuit breaker tripping assembly of claim 6, wherein the smaller dimension areas are defined across flats.

8. A tripping shaft apparatus, comprising:
a rigid shaft portion;
a first over-molded shaft portion molded onto the rigid shaft portion, the first over-molded shaft portion including at least a first molded lever;
a second lever spaced from the first molded lever; and
a torsion spring located between the first molded lever and the second lever, wherein the torsion spring includes a wound central portion received over a registry portion of the rigid shaft portion, a first spring arm configured to register on a lever, and a second spring arm configured to register on a first or a second side frame.

9. The tripping shaft apparatus of claim 8, comprising the first over-molded shaft portion molded on a first end of the rigid shaft portion, and a second over-molded shaft portion molded on a second end of the rigid shaft portion opposite the first end.

10. The tripping shaft apparatus of claim 8, wherein the rigid shaft portion comprises steel.

11. The tripping shaft apparatus of claim 8, wherein the rigid shaft portion comprises a first interface portion configured to interface with the first over-molded shaft portion, and a second interface portion configured to interface with a second over-molded shaft portion.

12. The tripping shaft apparatus of claim 8, wherein the first spring arm is configured to register on a third lever located between the first molded lever and second lever.

13. The tripping shaft apparatus of claim 12, wherein the third lever is molded to a third interface portion, the first spring arm is configured to register in a recess formed in the third lever, and the second spring arm is configured to register in a pocket formed in the first or second side frame.

14. The tripping shaft apparatus of claim 8, wherein the rigid shaft portion comprises bearing portions configured to rest in a first journal of a first side frame in a second journal of a second side frame.

15. The tripping shaft apparatus of claim 14, wherein the bearing portions comprise larger dimension areas adapted to contact the first and second journals, and smaller dimension areas configured to pass through an entry slot of the side frames.

16. The tripping shaft apparatus of claim 15, wherein the smaller dimension areas are defined across flats.

17. A method of assembly of a circuit breaker tripping assembly, comprising:

providing a tripping shaft apparatus including a rigid shaft portion and bearing portions, wherein the bearing portions include larger dimension areas and smaller dimension areas, a first over-molded shaft portion molded onto the rigid shaft portion, the first over-molded shaft portion including at least a first molded lever, a second lever spaced from the first molded lever, and a torsion spring located between the first molded lever and the second lever;

providing a frame including first and second side frames including first and second journals with entry slots into the first and second journals; and inserting the smaller dimension areas of the bearing portions of the tripping shaft apparatus through entry slots in the first and second side frames.

18. A method of assembly of a circuit breaker tripping assembly of claim 17, comprising:

rotating the tripping shaft apparatus to register spring aims of the torsion spring on the first molded lever and one of the first and second side frames.

* * * * *